US005259877A

United States Patent [19]

Ozaki

[11] Patent Number: 5,259,877

[45] Date of Patent: Nov. 9, 1993

[54] APPARATUS WITH CHANGEOVER GROOVES FOR FORMING PHOSPHOR LAYER IN CATHODE-RAY TUBE

[75] Inventor: Mitsuru Ozaki, Kanagawa, Japan

[73] Assignee: Sony Corporation, Japan

[21] Appl. No.: 850,040

[22] Filed: Mar. 12, 1992

[30] Foreign Application Priority Data

Mar. 19, 1991 [JP] Japan ..... 3-054827

[51] Int. Cl.[5] ..... B05C 11/08

[52] U.S. Cl. ..... 118/53; 118/56; 414/744.3; 901/12; 74/54; 74/567

[58] Field of Search ..... 118/53, 56; 414/225, 414/773, 774.3; 901/6, 12; 74/53, 54, 55, 567

[56] References Cited

U.S. PATENT DOCUMENTS

| | | | |
|---|---|---|---|
| 2,513,337 | 3/1946 | Liebmann | 74/567 |
| 2,544,199 | 3/1951 | Vredenburg | 118/56 |
| 3,080,765 | 3/1963 | Eisele | 74/567 |
| 3,240,358 | 3/1966 | Ferguson | 414/744.3 |
| 3,259,254 | 7/1966 | Mitchell | 901/12 |
| 3,319.556 | 5/1967 | Fiore . | |
| 3,319,759 | 5/1967 | Hajduk et al. . | |
| 3,376,153 | 4/1968 | Fiore . | |
| 3,672,932 | 6/1972 | D'Augustine . | |
| 3,832,211 | 8/1974 | Cook et al. | 118/56 |
| 3,899,994 | 8/1975 | Cook et al. | 118/56 |
| 4,069,724 | 1/1978 | Sobotta | 74/54 |
| 4,293,268 | 10/1981 | Mink | 901/12 |
| 4,760,671 | 8/1988 | Ward | 414/744.3 |

FOREIGN PATENT DOCUMENTS

| | | | |
|---|---|---|---|
| 2031286 | 1/1971 | Fed. Rep. of Germany . | |
| 294957 | 4/1932 | Italy | 74/567 |
| 203087 | 9/1923 | United Kingdom | 74/567 |
| 1158660 | 7/1969 | United Kingdom . | |

*Primary Examiner*—W. Gary Jones
*Assistant Examiner*—Todd J. Burns
*Attorney, Agent, or Firm*—Ronald P. Kananen

[57] ABSTRACT

An apparatus for forming phosphor layers in cathode-ray tubes includes a table having a plurality of operating positions for processing panels for cathode-ray tubes to coat phosphor layers thereon. A plurality of angularly spaced clamp heads for holding the panels, respectively, are supported on the table for rotation about a first axis and angular movement about a second axis in each of the operating positions. A cam, which is operatively connected to the clamp heads, has a first cam groove for angularly moving the clamp heads through different angles about the second axis in the operating positions and a second cam groove for keeping the clamp heads in a fixed angular position with respect to the second axis in the operating positions. Joint cam groove mechanisms are combined with the cam for selectively switching between the first and second cam grooves.

4 Claims, 11 Drawing Sheets

Revolved Through 180°

Developing

Revolved Through 105°

Drying

Revolved Through 14°

Slurry Pouring

Revolved Through 105°

Spinning and Discharging

Revolved Through 105°

Drying

APPARATUS WITH CHANGEOVER GROOVES FOR FORMING PHOSPHOR LAYER IN CATHODE-RAY TUBE

BACKGROUND OF THE INVENTION

1. Field of the Invention

The present invention relates to an apparatus for forming phosphor layers in cathode-ray tubes such as color cathode-ray tubes.

2. Description of the Prior Art

Phosphor layers in color cathode-ray tubes, e.g., stripe-type color phosphor layers comprising red, green, and blue phosphor stripes and black stripes (light absorbing layer) formed between the red, green, and blue phosphor stripes, are produced as follows: First, a photosensitive film of PVA (polyvinyl alcohol) is coated on the inner surface of the front panel of a cathode-ray tube. After the coated photosensitive film is dried, it is exposed to an ultraviolet radiation using color selecting electrode as an optical mask. The exposed photosensitive film is then developed by being washed with water, producing stripe-shaped resist layers corresponding in position to the respective colors. The entire panel surface including the resist layers is coated with a carbon slurry. The resist layers and the carbon layer thereon are then lifted off, providing carbon stripes, i.e., black stripes, in a given pattern. Then, the panel surface is coated with a green phosphor slurry. After the coated slurry is dried, it is exposed through the color selecting electrodes. The exposed slurry is developed, forming green phosphor stripes between the carbon stripes. Similarly, blue and red phosphor stripes are thereafter formed between the other carbon stripes. Subsequently, the stripes thus formed are coated with an intermediate film and then a metal backing layer of Al, thus producing a color phosphor layer.

The photosensitive film, the carbon slurry, and the phosphor slurries are poured, coated, discharged, dried, exposed, and developed by a phosphor layer forming apparatus.

FIG. 1 of the accompanying drawings fragmentarily shows a general phosphor layer forming apparatus. As shown in FIG. 1, the phosphor layer forming apparatus has an array of successive coating tables 1 for coating respective green, blue, and red phosphor films, and an array of successive exposure bases 2 corresponding respectively to the coating tables 1. Each of the coating tables 1 has a plurality of (e.g., twenty-four) radial panel supporting arms 4 mounted on a rotatable main shaft 3 on the coating table 1. Each of the arms 4 has on its distal end a clamp head 5 that is rotatable about its own axis and also angularly movable about another axis, for holding a cathode-ray tube panel. The coating table 1 is surrounded by a developing unit for developing a photosensitive film or slurry, a drying unit comprising a heater for drying a developed photosensitive film or slurry, a pouring unit for pouring a slurry or a photosensitive solution, a discharging unit for discharging the slurry or the photosensitive solution, and a drying unit comprising a heater for drying the photosensitive film or the slurry, the units being arranged along the circumference of the coating table 1. While the main shaft 3 makes one revolution, the cathode-ray tube panel held by each of the clamp heads 5 moves successively through the above units, which develop a photosensitive film or the slurry, dry the same, pour a slurry or a photosensitive solution, coat the panel with the slurry or the photosensitive solution while spinning the panel, discharge the slurry or the photosensitive solution, and dry the coated slurry or photosensitive solution.

In the above respective steps at the units, the panel 6, as shown in FIGS. 2A through 2E, is rotated about its own axis and also angularly moved about the other axis by the clamp head 5 (not shown in FIGS. 2A through 2E). In the developing step, the panel 6 is angularly moved about the other axis through 180° until the inner surface of the panel faces downwardly and is rotated about its own axis at a speed of 30 rpm, as shown in FIG. 2A. In the drying step after the development, the panel 6 is angularly moved about the other axis through 105° and rotated about its own axis at a speed of 100 rpm, as shown in FIG. 2B. In the slurry pouring step, the panel 6 is angularly moved about the other axis through an angle ranging from 14° to 10° and rotated about its own axis at a speed of 5 rpm, as shown in FIG. 2C. In the spin coating step and the slurry discharging steps, the panel 6 is angularly moved about the other axis through 105° and rotated about its own axis at a speed of 170 rpm, as shown in FIG. 2D. In the slurry drying step, the panel 6 is angularly moved about the other axis through 105° and rotated about its own axis at speeds of 8 and 30 rpm, as shown in FIG. 2E.

After a desired slurry or photosensitive film is coated on the panel on one of the coating tables 1, the panel is transferred to the downstream exposure base 2 for exposure to an ultraviolet radiation. After the panel is exposed, the panel is unloaded or transferred to the next coating table 1.

On each of the coating tables 1, the clamp head 5 is rotated about its own axis by a motor, and angularly moved about the other axis through varying angles by either a cam groove or a motor. FIG. 3 of the accompanying drawings shows a conventional cam plate 7 having a cam groove 8 for angularly moving the clamp head 5. When a cam roller associated with the clamp head 5 moves along the cam groove 8, the clamp head 5 is angularly moved through an angle that varies depending on the step.

In the event of a failure occurring in one of the steps, panels get jammed on one of the exposure bases 2 to the extent that no more panels can be loaded or transferred from the upstream coating table 1 to the exposure base 2. On the coating table 1, the clamp heads 5 with the panels held respectively thereby are turned again in the respective steps.

Under normal conditions, the clamp heads 5 are stably angularly moved by the mechanical arrangement including the cam. If the clamp heads 5 are caused to turn in the respective steps due to a failure, however, the coating film on the inner surface of the panel is excessively heated by the heater. All the panels that are carried by those clamp heads which are turned again become defective when excessively heated.

With the motor used to angularly move each of the clamp heads 5, when the clamp head 5 is caused to turn again due to a failure, the motor may be controlled to direct the inner surface of the panel upwardly so that it will not be excessively heated by the heater. However, because of a complex control system required to control the motor and also the reliability of electric components used, the time efficiency of the entire system remains lower than a certain level.

OBJECTS AND SUMMARY OF THE INVENTION

In view of the aforesaid drawbacks of the conventional apparatus for forming phosphor layers in cathode-ray tubes, it is an object of the present invention to provide an apparatus for forming phosphor layers in cathode-ray tubes, the apparatus having clamp heads that can be angularly moved by a cam and being arranged to avoid defective coating films which would otherwise be produced on the inner surfaces of panels held by the clamp heads.

According to the present invention, there is provided an apparatus for forming phosphor layers in cathode-ray tubes, comprising a table having a plurality of operating positions for processing panels for cathode-ray tubes to coat phosphor layers thereon, a plurality of angularly spaced clamp heads for holding the panels, respectively, the clamp heads being supported on the table for rotation about a first axis and angular movement about a second axis in each of the operating positions, a cam operatively connected to the clamp heads, the cam having a first cam groove for angularly moving the clamp heads through different angles about the second axis in the operating positions and a second cam groove for keeping the clamp heads in a fixed angular position with respect to the second axis in the operating positions, and means combined with the cam, for selectively switching between the first and second cam grooves.

The cam comprises a cam roller operatively connected to each of the clamp heads and rollingly engaging in one of the first and second cam grooves at a time, and a cam plate. The first cam groove is defined in the cam plate and having an undulating annular configuration, and the second cam groove is defined in the cam plate in radially spaced relationship to the first cam groove and having a circular configuration.

The means combined with the cam comprises a cam groove mechanism disposed in the cam plate across the first and second cam grooves. The cam groove mechanism has a cam groove for receiving the cam roller, the cam groove being movable from a position aligned with the first cam groove to a position aligned with the second cam groove.

The cam groove mechanism comprises a pair of drive rollers, an endless belt trained around the drive rollers, and an array of cam plate members supported on the endless belt, each of the cam plate members having the cam groove.

When the apparatus is operating under normal condition, the cam roller moves in and along the first cam groove, angularly moving the clamp heads through respective angles in the operating positions. In the event of a failure, causing the panels to move again through the operating positions without being transferred to a next processing station, the cam roller is shifted by the cam groove mechanism from the first cam groove to the second cam groove, by which the clamp heads are angularly moved into a fixed angular position, i.e., the inner surfaces of the panels held by the clamp heads are successively turned upwardly. Therefore, coating layers that have already formed on the inner surfaces of the panels are prevented from being rendered defective in some of the operating positions.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 1:
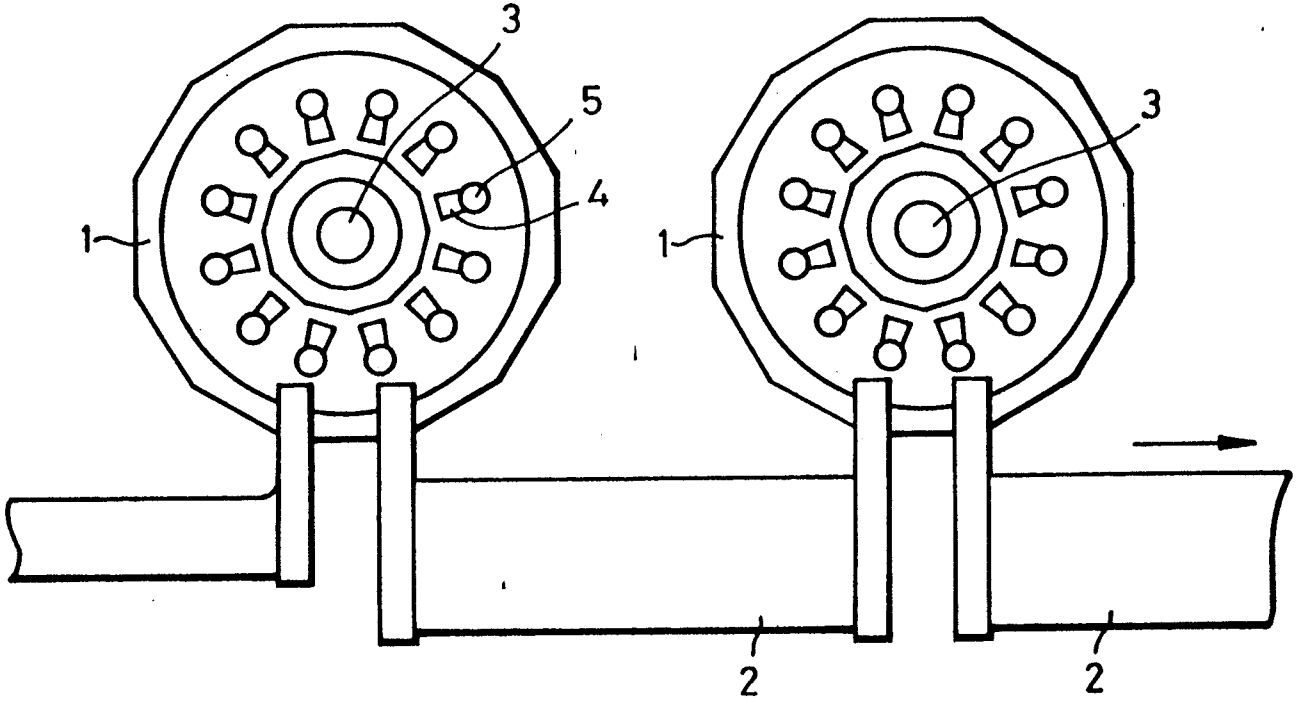
FIG. 1 is a fragmentary plan view of a general apparatus for forming phosphor layers in cathode-ray tubes.
Figure 2A:
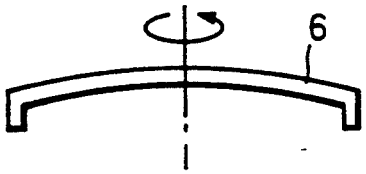
FIGS. 2A through 2E are views showing respective angles through which a cathode-ray tube panel is angularly moved in different steps.
Figure 2B:
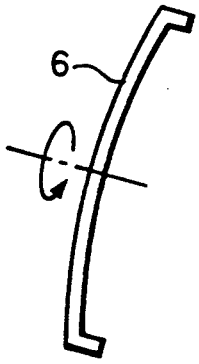
Figure 2C:
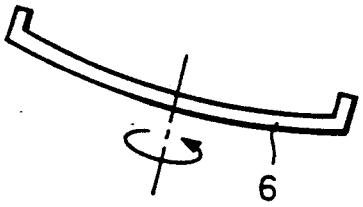
Figure 2D:
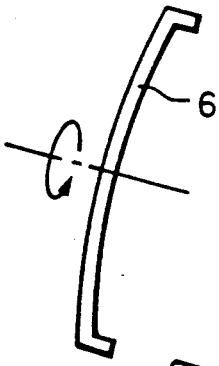
Figure 2E:
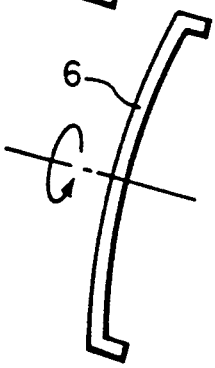
Figure 3:
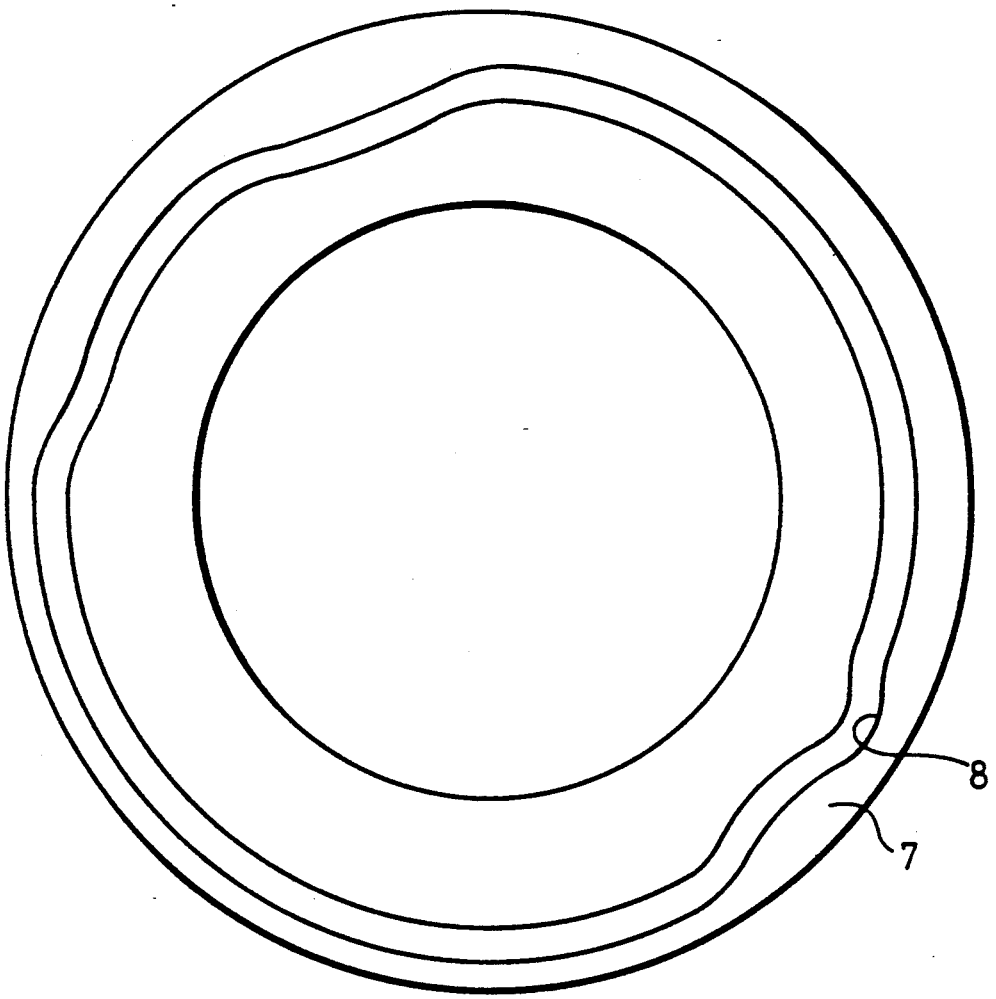
FIG. 3 (PRIOR ART)
FIG. 3 is a plan view of a conventional cam plate having a cam groove for angularly moving the cathode-ray tube panel through varying angles.
Figure 4:
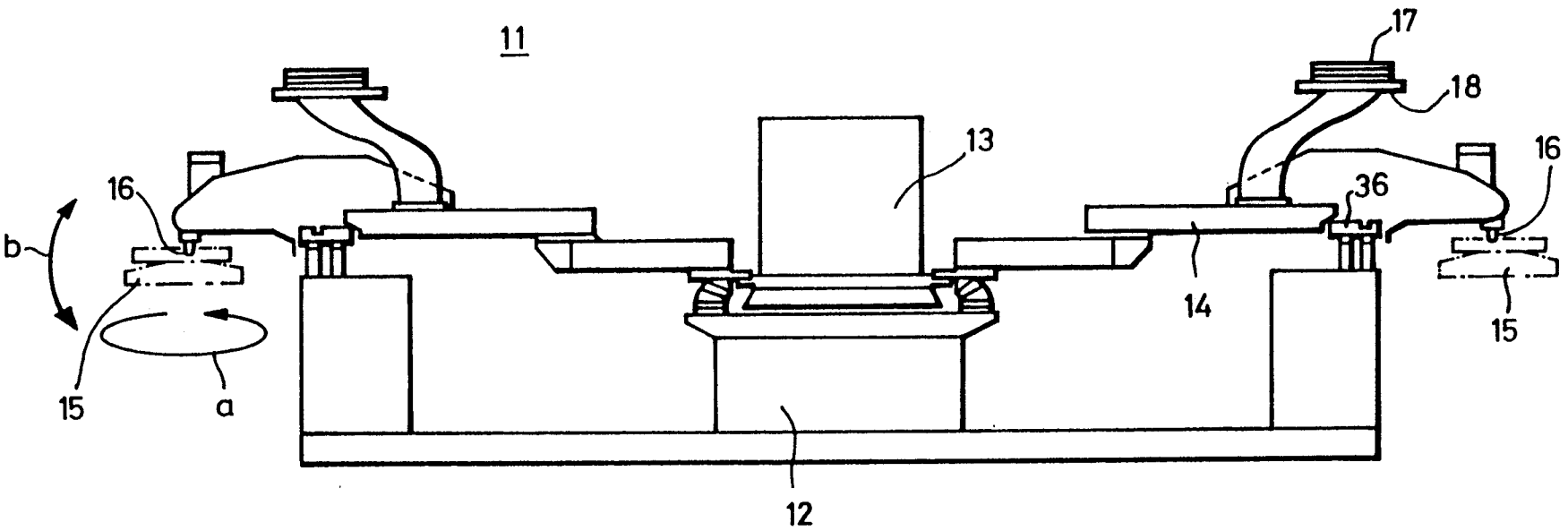
FIG. 4 is a front elevational view of a coating table of an apparatus for forming phosphor layers in cathode-ray tubes according to the present invention.
Figure 5:
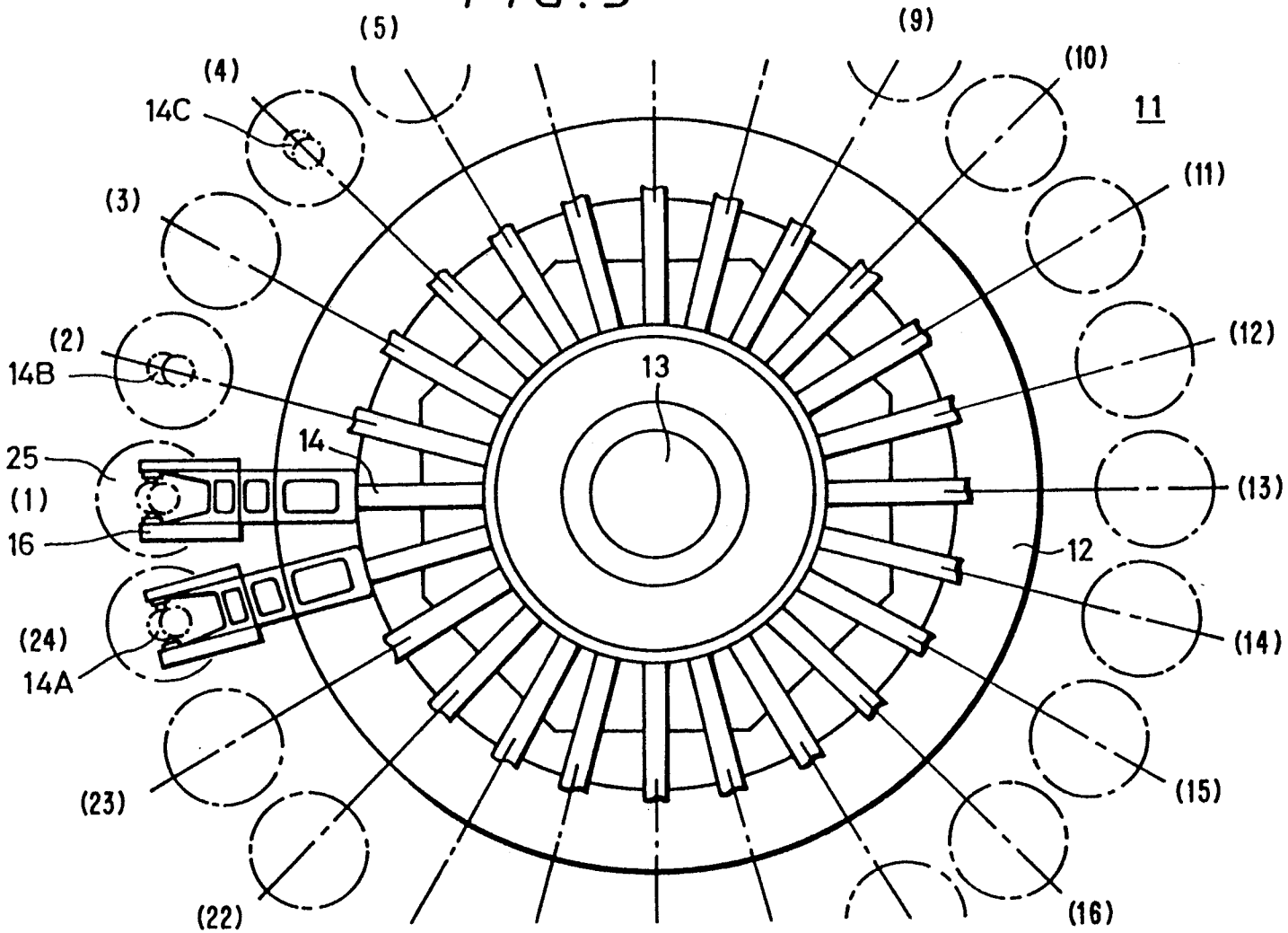
FIG. 5 is an enlarged plan view of the coating table shown in FIG. 4.

FIGS. 4 and 5 show a coating table of an apparatus for forming phosphor layers in cathode-ray tubes according to the present invention.

The coating table, generally designated by the reference numeral 11, comprises a circular table base 12, a rotatable main shaft 13 mounted centrally on the table base 12, a plurality of (e.g., twenty-four) arms 14 (14A, 14B, . . . ) supported on the table base 12 for angular movement in a horizontal plane by and about the rotatable main shaft 13, and a plurality of clamp heads 16 mounted on respective radially outer distal ends of the arms 14 for holding panels 15, respectively, for cathode-ray tubes.

The arms 14 extend radially and are angularly spaced around the rotatable main shaft 13 at equal angular intervals corresponding to respective steps or operating positions (1) through (24) for developing a photosensitive film or slurry, drying a developed photosensitive film or slurry, pouring a slurry or a photosensitive solution, discharging the slurry or the photosensitive solution, and drying the photosensitive film or the slurry. The arms 14 are indexed or intermittently angularly moved successively through these steps or operating positions (1) through (24) by and about the rotatable main shaft 13. Each of the arms 14 supports a color selecting electrode tray 18 for placing thereon a color selecting electrode to be paired with the panel 15 held by the clamp head 16 on the arm 14.

Each of the clamp heads 16 is rotatable about a vertical axis in the direction indicated by the arrow a, and angularly movable about a horizontal axis in a vertical plane in the direction indicated by the arrow b, with respect to the radially outer distal end of the arm 14.

Figure 6:
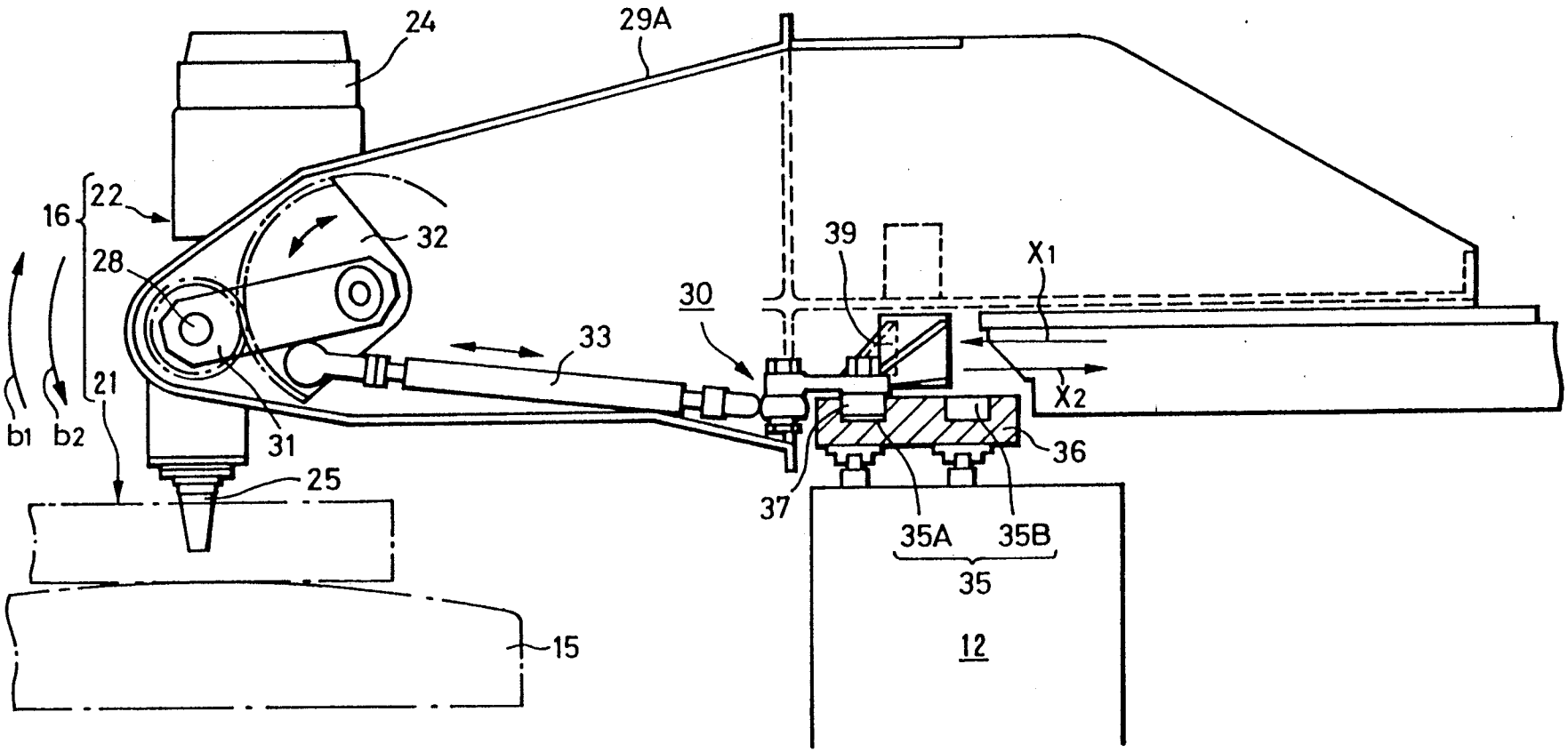
FIG. 6 is an enlarged elevational view of a clamp head on the coating table shown in FIG. 5.
Figure 7:
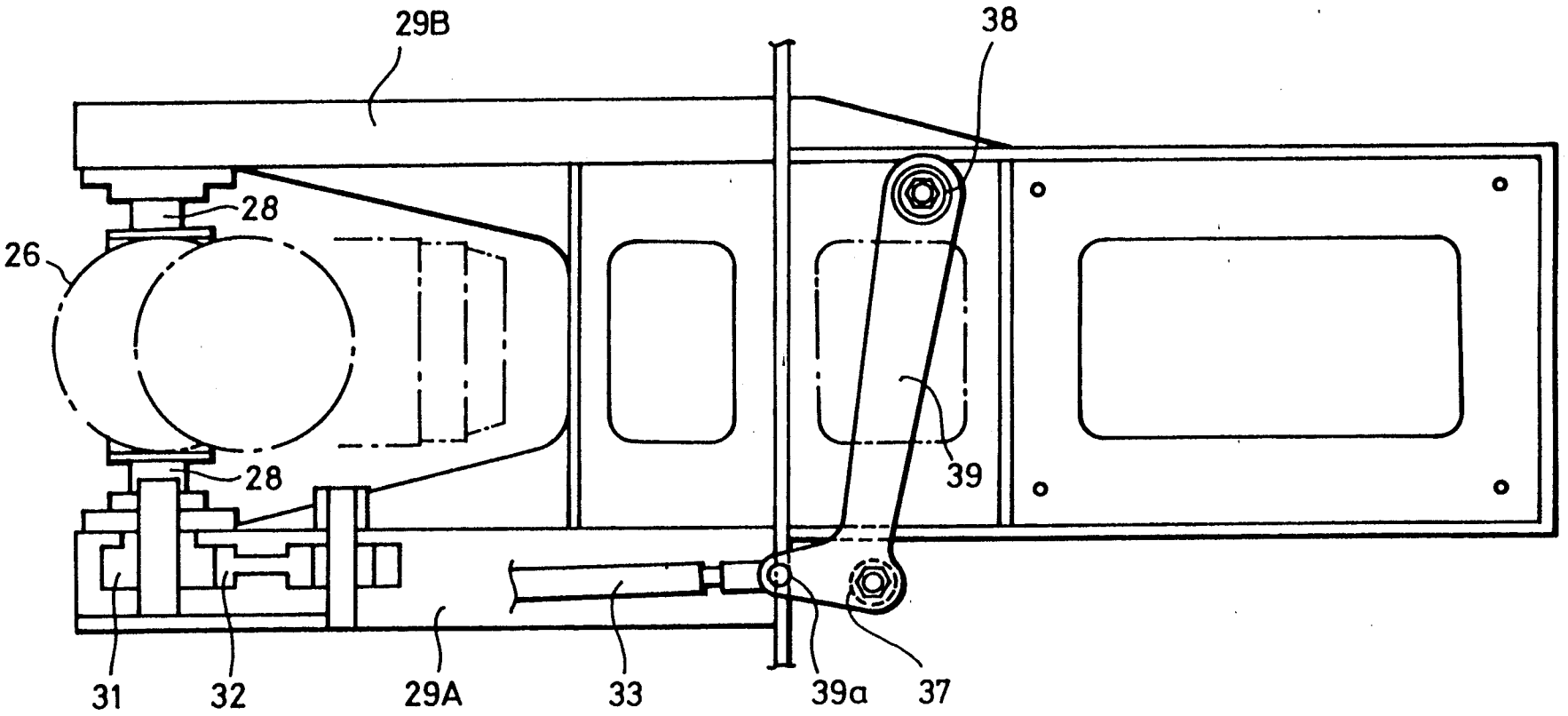
FIG. 7 is a plan view of the clamp head shown in FIG. 6.

As shown in FIGS. 6 and 7, the clamp head 16 comprises a clamp mechanism 21 for clamping or holding the panel 15, and an actuator 22 for rotating the clamp mechanism 21. The clamp mechanism 21 may comprise a mechanism for attracting the front surface of the panel 15 under vacuum or a mechanism for gripping four outer sides of the panel 15. The actuator 22 comprises a motor 24 for rotating a shaft 25 housed in an outer sleeve 26. Another shaft 28 which extends horizontally perpendicularly to the shaft 25 is fixedly mounted on the outer sleeve 26. The shaft 28 is supported by bearings on and between a pair of horizontally spaced support arm members 29A, 29B on the distal end of the arm 14.

As shown in FIGS. 6 and 7, the shaft 28 is angularly movable by a cam mechanism 30. The cam mechanism 30 comprises a cam plate 36 (see FIG. 8) having two, first and second, annular cam grooves 35 (35A, 35B) defined in an upper surface thereof and extending fully circumferentially around the table base 12, the cam plate 36 being supported on the table base 12, a cam roller 37 rollingly engaging in the cam groove 35, and a link 33 coupled to the cam roller 37, and intermeshing first and second gears 31, 32 disposed between and coupled to the shaft 28 and the link 33. The first gear 31, which is circular in shape, is mounted on one end of the shaft 28. The second gear 32, which is of a sector shape, has a larger diameter than the first gear 31, and is held in mesh with the first gear 31. The cam roller 37 is mounted on a corner of an end 39*a* of a substantially L-shaped support member 39 that is angularly movably supported at the other end 38 thereof on the arm 14 near the proximal ends of the support arm members 29A, 29B. The end 39*a* of the support member 39 is operatively connected to one end of the link 33 whose other end is operatively connected to the second gear 32. The gears 31, 32 and the link 33 are disposed within the support arm member 29A.

When the cam roller 37 moves along the cam grooves 35 radially with respect to the table base 12, i.e., when the cam roller 37 moves in the direction indicated by the arrow $X_1$ in FIG. 6, the support member 39 is angularly moved clockwise about the end 38, causing the link 33 to rotate the gears 31, 32. The shaft 28 is now turned about its own axis thereby to angularly move the clamp head 16 downwardly in the direction indicated by the arrow $b_2$. Conversely, when the cam roller 37 moves in the direction indicated by the arrow $X_2$ in FIG. 6, the clamp head 16 is angularly moved upwardly in the direction indicated by the arrow $b_1$.

As described above, the cam plate 36 has the two annular grooves 35A, 35B. The first annular cam groove 35A serves to determine the angle through which the clamp head 16 is to be angularly moved in each of the steps or operating positions on the coating table 11 under a normal condition. The second annular cam groove 35B serves to set the angle through which the clamp head 16 is to be angularly moved, to 0° to direct the inner surface of the clamped panel 15 upwardly under a retracted condition. The second cam groove 35B is positioned radially inwardly of the first cam groove 35A. The first cam groove 35A is of an undulating or wavy annular configuration to angularly move the clamp head 16 through different angles in the respective steps or operating positions. The second cam groove 35B is of a circular shape to set the clamp head angle to 0° in all of the steps or operating positions. As described below, these first and second cam grooves 35A, 35B are completely closed as annular cam grooves by cam grooves of joint cam groove mechanisms.

Figure 8:
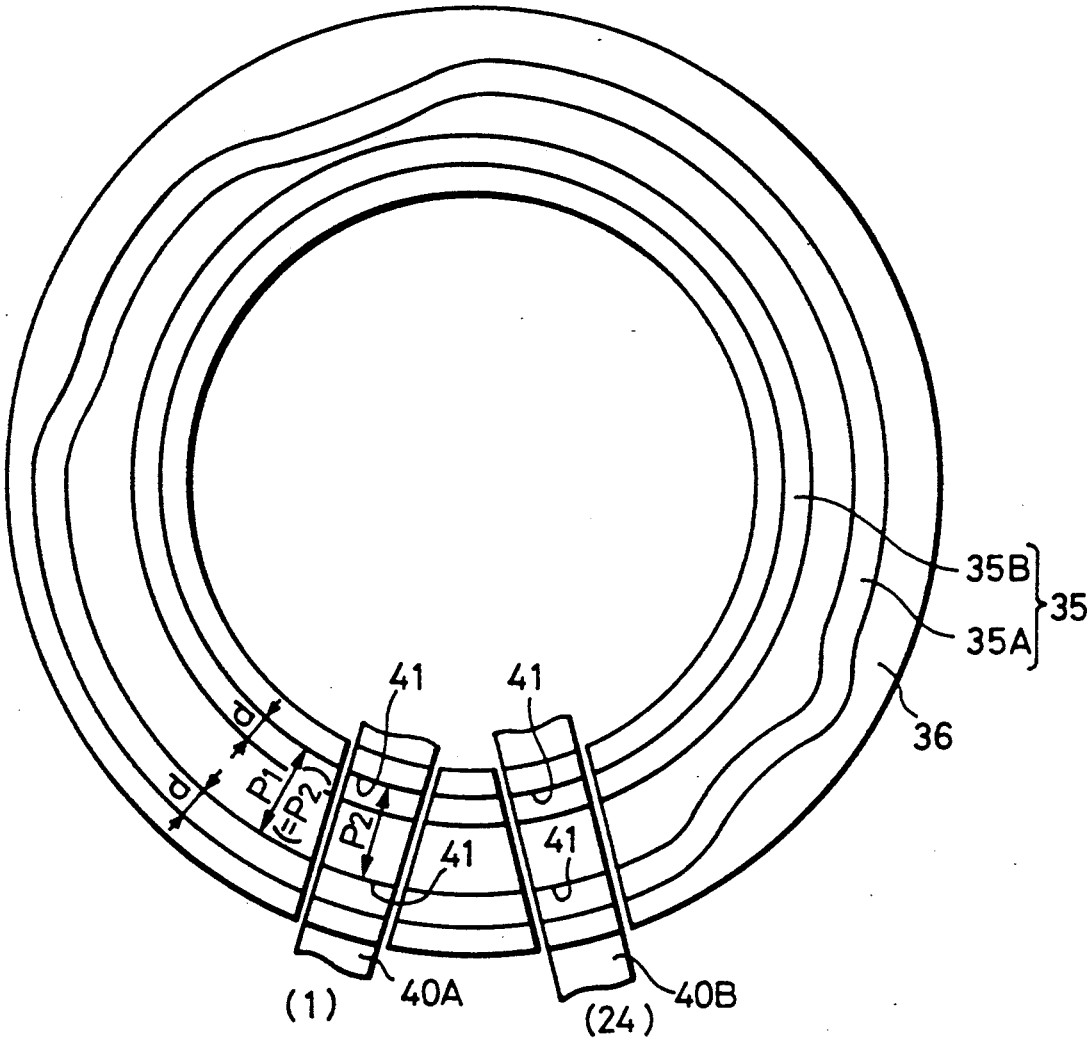
FIG. 8 is a plan view of a cam plate used in combination with the clamp head shown in FIG. 6.
Figure 9:
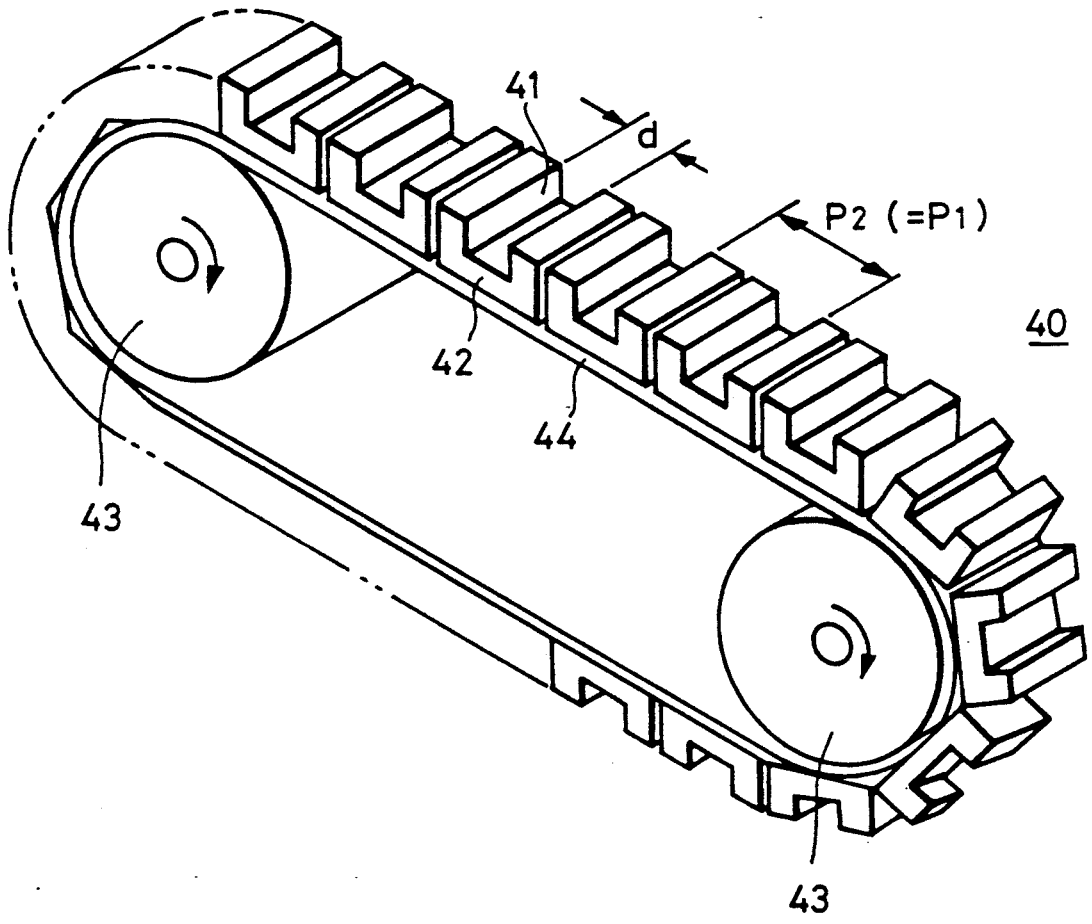
FIG. 9 is a perspective view of a joint cam groove mechanism.

As shown in FIGS. 8 and 9, the apparatus also has two joint cam groove mechanisms 40 (40A, 40B) for shifting the cam roller 37 between the first and second cam grooves 35A, 35B in certain steps or operating positions, e.g., the operating position (1) for transferring or loading a panel 15 from a previous processing station, e.g., an exposure base, to the coating table 11 and the operating position (24) for transferring or unloading a panel 15 from the coating table 11 to a next processing station, e.g., an exposure base. These joint cam groove mechanisms 40A, 40B may also be disposed in any desired operating positions other than the operating positions (1), (24). The joint cam groove mechanisms 40A, 40B are positioned in recesses defined in the cam plate 36 across the first and second cam grooves 35A, 35B.

The cam plate 36 is composed of a plurality of joined cam plate members which correspond to the respective steps or operating positions.

As shown in FIG. 9, each joint cam groove mechanism 40 comprises an array of cam plate members 42 each having a cam groove 41 having the same width d as that of the first and second cam grooves 35A, 35B, and an endless belt 44 trained around a pair of drive rollers 43 and supporting the array of cam plate members 42 on its outer circumferential surface. The cam grooves 41 of the cam plate members 42 are spaced at a pitch $P_2$ which is the same as the pitch $P_1$ (see FIG. 8) of the first and second cam grooves 35A, 35B. Although not shown, the cam plate members 42 of the joint cam groove mechanisms 40 may be actuated by a cylinder.

Operation of the apparatus, i.e., the coating table 11, will be described below.

While the apparatus is operating normally, the joint cam groove mechanisms 40A, 40B are held at rest, and the first and second cam grooves 35A, 35B are completed as annular cam grooves by the cam grooves 41 of the joint cam groove mechanisms 40A, 40B, with the cam rollers 37 engaging in the first cam groove 35A. Panels 15 are successively supplied to and held by the clamp heads 16 in the panel loading position (1), and are intermittently moved successively through the operating positions (2)~(23) by the rotatable main shaft 13. The angle through which each of the clamp heads 16 is to be angularly moved about the shaft 28 is determined depending on the position of the cam roller 37 in the first cam groove 35A. The panels 15 held by the respective clamp heads 16 as they are angularly moved through the respective angles about the shaft 28 are processed in the respective operating positions (2)~(23). After each panel is processed in the final operating position (23), the clamp head 16 moves to the panel unloading position (24), from which the panel 15 is transferred to a next processing station such as an exposure base.

Figure 11:
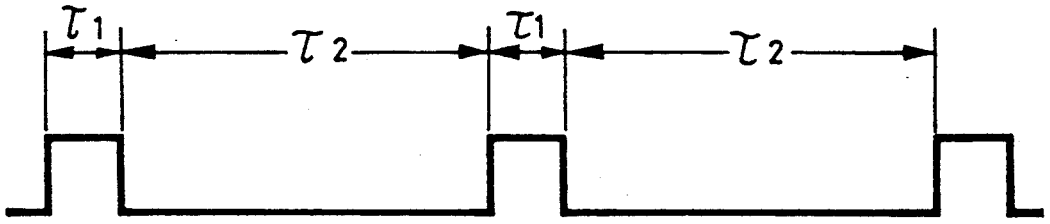
FIG. 11 is a timing chart of operation of the clamp head.

Each clamp head 16 is indexed or intermittently moved by the main shaft 13 according to a timing sequence shown in FIG. 11. Specifically, the clamp head 16 moves from one operating position to a next operating position within a period $\tau_1$ of 3 seconds, for example, and the panel 15 clamped by the clamp head 16 is processed in the next operating position within a period of $\tau_2$ of 16 seconds, for example.

Figure 10:
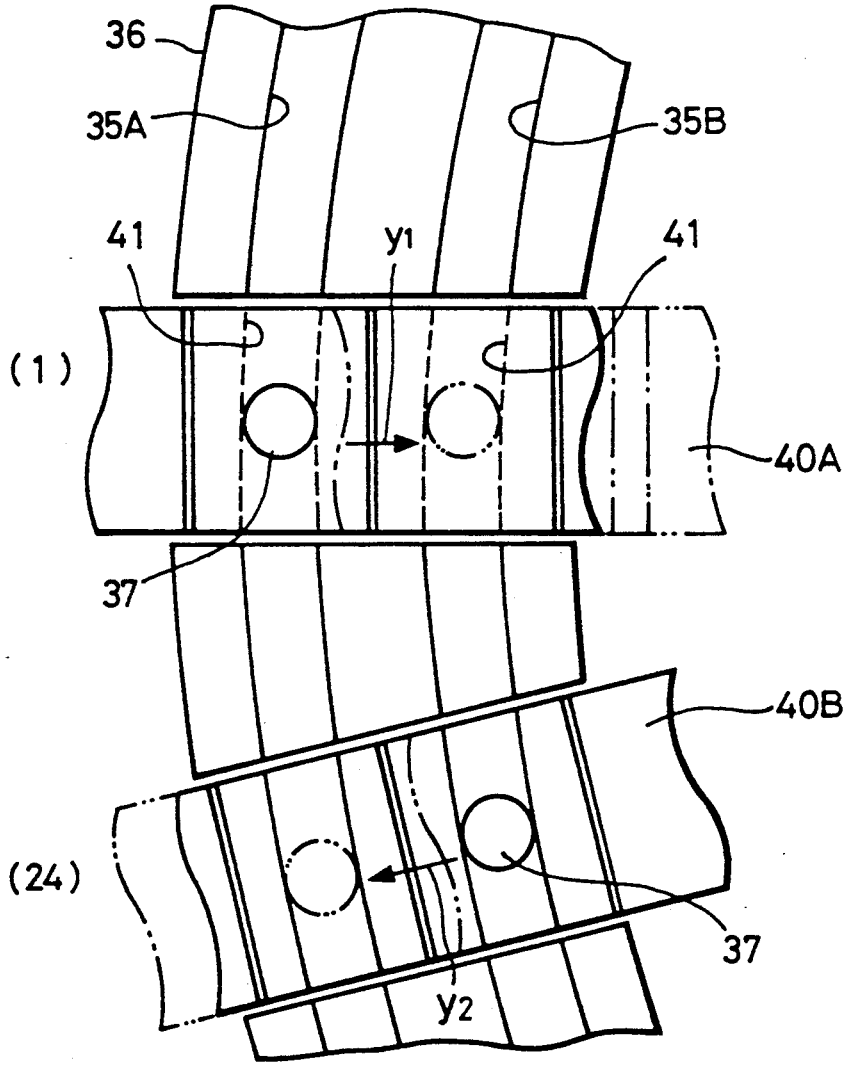
FIG. 10 is an enlarged fragmentary plan view illustrative of the manner in which the joint cam groove mechanisms operate with the cam plate.

In the event of a failure in the apparatus, causing the panels 15 to get jammed on the exposure bases, the panel 15 held by the clamp head 16 in the panel unloading position (24) on the coating table 11 is moved to the panel loading position (1) again. When the panel 15 from the panel unloading position (24) is moved to the panel loading position (1) again, the cam roller 37 associated with the clamp head 16 moving to the panel loading position (1) is positioned in one of the cam grooves 41 of the joint cam groove mechanism 40A, as shown in FIG. 10.

When the failure is detected, and after the clamp head 16 is moved to the panel loading position (1) again, the joint cam groove mechanism 40A is actuated one cam groove pitch in the direction indicated by the arrow $y_1$ in a period $\tau_2$ in response to a failure signal indicative of the detected failure, shifting the cam groove 41 with the cam roller 37 positioned therein from the position aligned with the first cam groove 35A to the position aligned with the second cam groove 35B. Since the cam roller 37 is now aligned with the second cam groove 35B, the angle through which the clamp head 16 is angularly moved about shaft 28 is 0°, and the inner surface of the panel 15 clamped by the clamp head 16 is directed upwardly. As the main shaft 13 is turned, the cam roller 37 is moved from the cam groove 41 into the second cam groove 35B on the way to the next operating position (2). The cam roller 37 remains in the second cam groove 35B until the failure is remedied. Therefore, the coating on the inner surface of the panel 15, which is directed upwardly, is not adversely affected by the heat of the heaters in some of the operating positions, and remains in good condition.

Then, the next clamp head 16 with the corresponding panel 15 held thereby is moved from the panel unloading position (24) back to the panel loading position (1). The joint cam groove mechanism 40A is actuated again in a period $\tau_2$ to shift the corresponding cam roller 37 from the first cam groove 35A to the second cam groove 35B. The cam roller 37 is also guided in and along the second cam groove **35*b* until the failure is removed. Therefore, the coating on the inner surface of the panel 15** remains unaffected by the heat of the heaters.

When the failure is remedied and the panels start moving on the exposure panels, the joint cam groove mechanism 40B in the panel unloading position (24) (see FIG. 10) is actuated in the direction indicated by the arrow $y_2$ in a period $\tau_2$, moving the cam roller 37 in one of the cam grooves 41 of the joint cam groove mechanism 40B from the position aligned with the second cam groove 35B to the position aligned with the first cam groove 35A. The clamp head 16 associated with the cam roller 37 can now be angularly moved about the shaft 28 through the angle determined by the first cam groove 35A.

As described above, in the event of a failure, the cam roller 37 associated with the clamp head 16 that moves from the panel unloading position (24) to the panel loading position (1) again is shifted from the first cam groove 35A to the second cam groove 35B, turning upwardly the inner surface of the panel 15 clamped by the clamp head 16. Consequently, the coating on the inner surface of the panel 15 will not be adversely affected, e.g., excessively dried, by the heat of the heaters in some of the operating positions. Therefore, high-quality coating films or phosphor layers can be formed highly reliably in cathode-ray tubes with a high yield.

The present invention has been illustrated as being embodied in a circular coating table 11 as viewed in plan. However, the principles of the invention are also applicable to an elliptical coating table as viewed in plan.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. An apparatus for forming phosphor layers in cathode-ray tubes, comprising:

a table having a plurality of operating positions for processing panels for cathode-ray tubes to coat phosphor layers thereon;

a plurality of angularly spaced clamp heads for holding the panels, respectively, said clamp heads being supported on said table for rotation about a first axis and angular movement about a second axis in each of said operating positions;

a cam operatively connected to said clamp heads, said cam having a first means, including a first cam groove, for angularly moving said clamp heads through different angles about said second axis in said operating positions, a second means, including a second cam groove, for keeping said clamp heads in a fixed angular position with respect to said second axis in said operating positions and a cam element operatively connected to each of said clamp heads for engaging and following said cam grooves; and means combined with said cam, for selectively switching said cam elements between said first and second cam grooves.

2. An apparatus according to claim 1, wherein said cam elements each comprises a cam roller rollingly engaging in one of said first and second cam grooves at a time, and a cam plate, said first cam groove being defined in said cam plate and having an undulating annular configuration, said second cam groove being defined in said cam plate in radially spaced relationship to said first cam groove and having a circular configuration.

3. An apparatus according to claim 2, wherein said selective switching means comprises a cam groove mechanism disposed in said cam place across said first and second cam grooves, said cam groove mechanism having a cam groove for receiving said cam roller, said cam groove of the cam groove mechanism being movable from a position aligned with said first cam groove to a position aligned with said second cam groove.

4. An apparatus for forming phosphor layers in cathode-ray tubes, comprising:

a table having a plurality of operating positions for processing panels for cathode-ray tubes to coat phosphor layers thereon;

a plurality of angularly spaced clamp heads for holding the panels, respectively, said clamp heads being supported on said table for rotation about a first axis and angular movement about a second axis in each of said operating positions;

a cam operatively connected to said clamp heads, said cam having a first cam groove for angularly moving said clamp heads through different angles about said second axis in said operating positions, a second cam groove for keeping said clamp heads in a fixed angular position with respect to said second axis in said operating positions and a cam element operatively connected to each of said cam heads for engaging and following said cam grooves; and means combined with said cam, for selectively switching said cam elements between said first and second cam grooves; wherein said cam elements each comprises a cam roller rollingly engaging in one of said first and second cam grooves at a time, and a cam plate, said first cam groove being defined in said cam plate and having an undulating annular configuration, said second cam groove being defined in said cam plate in radially spaced relationship to said first cam groove and having a circular configuration; said selective switching means comprises a cam groove mechanism disposed in said cam plate across said first and second cam grooves, said cam groove mechanism having a cam groove for receiving said cam roller, said cam groove of the cam groove mechanism being movable from a position aligned with said first cam groove to a position aligned with said second cam groove; and wherein said cam groove mechanism comprises a pair of drive rollers, an endless belt trained around said drive rollers, and an array of cam plate members supported on said endless belt, each of said cam plate members having said cam groove.

* * * * *